US011271339B2

(12) United States Patent
Lee et al.

(10) Patent No.: US 11,271,339 B2
(45) Date of Patent: Mar. 8, 2022

(54) CONNECTOR ASSEMBLY AND METHOD OF MANUFACTURING THE SAME

(71) Applicant: Tyco Electronics AMP Korea Co., Ltd., Gyungsan-si (KR)

(72) Inventors: Chang-Ho Lee, Gyungsan-si (KR); Keun Taek Lim, Gyungsan-si (KR)

(73) Assignee: Tyco Electronics AMP Korea Co., Ltd., Gyeongsan-si (KR)

( * ) Notice: Subject to any disclaimer, the term of this patent is extended or adjusted under 35 U.S.C. 154(b) by 39 days.

(21) Appl. No.: 16/839,936

(22) Filed: Apr. 3, 2020

(65) Prior Publication Data

US 2021/0313727 A1 Oct. 7, 2021

(51) Int. Cl.
*H01R 13/424* (2006.01)
*H01R 43/20* (2006.01)
*H01R 13/506* (2006.01)

(52) U.S. Cl.
CPC ..... *H01R 13/424* (2013.01); *H01R 13/506* (2013.01); *H01R 43/205* (2013.01)

(58) Field of Classification Search
CPC .. H01R 13/424; H01R 13/506; H01R 43/205; H01R 12/62
See application file for complete search history.

(56) References Cited

U.S. PATENT DOCUMENTS 4,358,173 A * 11/1982 Conrad ..... H01R 12/62 439/67
5,099,393 A * 3/1992 Bentlage ..... H01L 23/32 174/541
5,380,221 A 1/1995 Grabbe
6,773,287 B2 8/2004 Takashita
7,510,425 B2 3/2009 Kuo et al.
9,312,631 B2 4/2016 Schrader
10,270,191 B1 * 4/2019 Li ..... H01R 12/62
2002/0102875 A1 * 8/2002 Durocher ..... H01R 12/62 439/493
2009/0088012 A1 * 4/2009 Ooka ..... H01R 13/187 439/260
2012/0184126 A1 * 7/2012 Chen ..... H01R 13/504 439/345
2013/0109212 A1 5/2013 Ohyama et al.
2020/0335898 A1 * 10/2020 Arai ..... H01R 13/518
(Continued)

FOREIGN PATENT DOCUMENTS

CN 1584679 A 2/2005
CN 103038952 A 4/2013
CN 104040796 A 9/2014
(Continued)

OTHER PUBLICATIONS

Abstract of related patent KR20160132526, dated Feb. 3, 2017, 1 page.

(Continued)

*Primary Examiner* — Tho D Ta
(74) *Attorney, Agent, or Firm* — Barley Snyder

(57) ABSTRACT

A connector assembly includes an inner housing, a substrate inserted into the inner housing, and a terminal position assurance (TPA) member supporting the substrate for the substrate not to be separated from the inner housing. The TPA member having a hot staking protrusion penetrating through the substrate and the inner housing.

20 Claims, 9 Drawing Sheets

(56) References Cited

U.S. PATENT DOCUMENTS

2020/0403330 A1* 12/2020 Liao ..... H01R 12/57

FOREIGN PATENT DOCUMENTS

| | | | |
|---|---|---|---|
| JP | 8180940 | A | 7/1996 |
| KR | 100675046 | B1 | 1/2007 |
| KR | 101001738 | B1 | 12/2010 |
| KR | 101570714 | B1 | 11/2015 |
| KR | 1020160029196 | A | 3/2016 |
| KR | 101702430 | B1 | 2/2017 |
| WO | 2014208306 | A1 | 12/2014 |

OTHER PUBLICATIONS

Abstract of related patent KR20090133055, dated Dec. 15, 2010, 1 page.
National Intellectual Property Administration, P.R. China, Search Report and First Office Action, dated Jun. 3, 2021, 21 pages.
Abstract of CN 1584679, dated Feb. 23, 2005, 1 page.

* cited by examiner

CONNECTOR ASSEMBLY AND METHOD OF MANUFACTURING THE SAME

FIELD OF THE INVENTION

The present invention relates to a connector assembly and, more particularly, to a connector assembly with a terminal position assurance member.

BACKGROUND

A connector is a type of electric component that allows or blocks an electrical connection. Connectors are used in various electromechanical devices such as automobiles or home appliances to enable an electrical and/or physical connection between a plurality of electronic components. When a connector is used in a moving electromechanical device, such as an automobile, if there is a gap between components of the connector, friction between the components may cause noise, and moreover, repeated movements may result in an electrical disconnection.

SUMMARY

A connector assembly includes an inner housing, a substrate inserted into the inner housing, and a terminal position assurance (TPA) member supporting the substrate for the substrate not to be separated from the inner housing. The TPA member having a hot staking protrusion penetrating through the substrate and the inner housing.

BRIEF DESCRIPTION OF THE DRAWINGS

These and/or other aspects, features, and advantages of the invention will become apparent and more readily appreciated from the following description of example embodiments, taken in conjunction with the accompanying drawings of which.

DETAILED DESCRIPTION OF THE EMBODIMENTS

Figure 1:
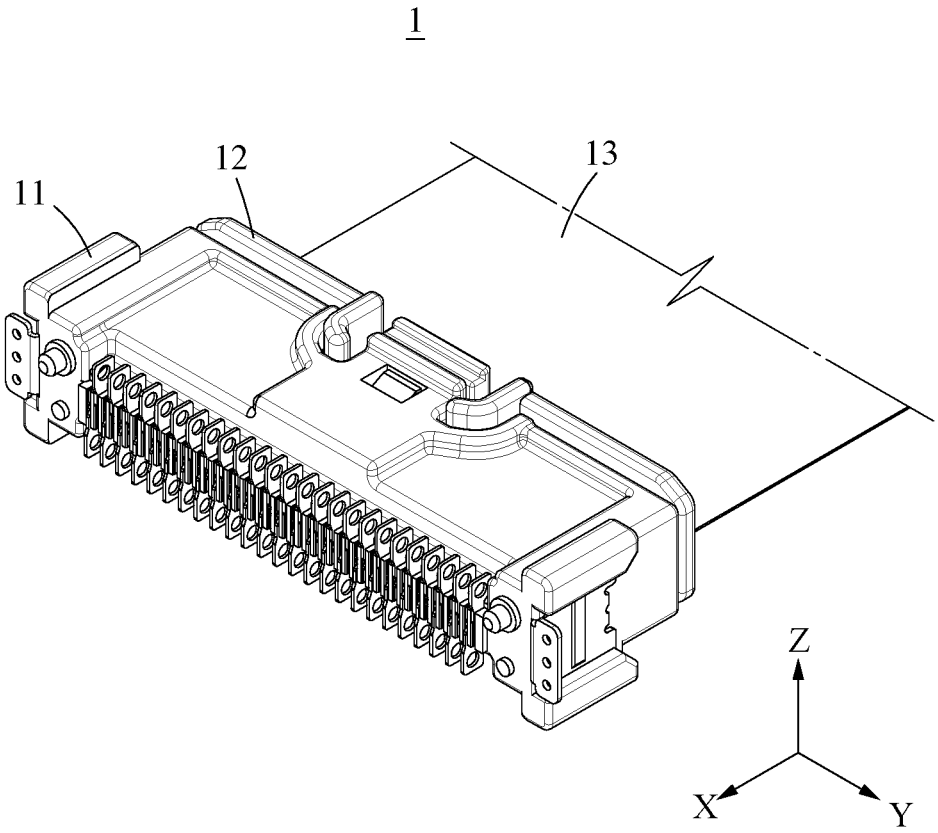
FIG. 1 is a perspective view of a connector assembly according to an embodiment.

Hereinafter, some example embodiments will be described in detail with reference to the accompanying drawings. Regarding the reference numerals assigned to the elements in the drawings, it should be noted that the same elements will be designated by the same reference numerals, wherever possible, even though they are shown in different drawings. Also, in the description of example embodiments, detailed description of well-known related structures or functions will be omitted when it is deemed that such description will cause ambiguous interpretation of the present disclosure.

In addition, terms such as first, second, A, B, (a), (b), and the like may be used herein to describe components. Each of these terminologies is not used to define an essence, order or sequence of a corresponding component but used merely to distinguish the corresponding component from other component(s). It should be noted that if it is described in the specification that one component is "connected", "coupled", or "joined" to another component, a third component may be "connected", "coupled", and "joined" between the first and second components, although the first component may be directly connected, coupled or joined to the second component.

The same name may be used to describe an element included in the example embodiments described above and an element having a common function. Unless otherwise mentioned, the descriptions on the example embodiments may be applicable to the following example embodiments and thus, duplicated descriptions will be omitted for conciseness.

Figure 2:
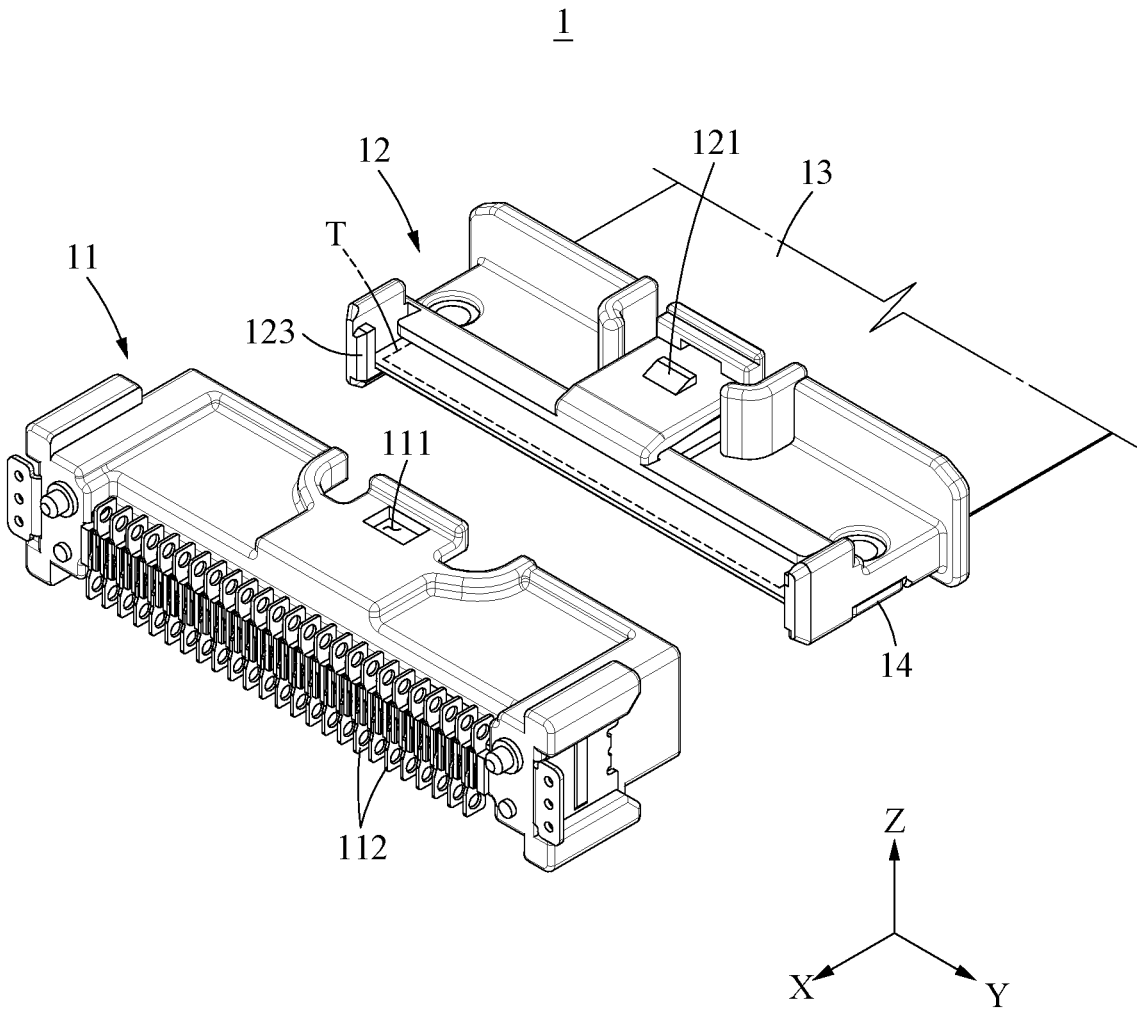
FIG. 2 is an exploded perspective view of the connector assembly.

A connector assembly 1 according to an embodiment, as shown in FIGS. 1 and 2, may electrically connect an electronic circuit formed on a substrate 13 to an external electronic component. It is inefficient to individually customize the shape of the substrate 13 to the external electronic component. Thus, a manner of assembling, through predetermined components, the substrate 13 and an outer housing 11 including a separate connection terminal 112 appropriate for the external electronic component may be used. The connector assembly 1 may include the outer housing 11, an inner housing 12, the substrate 13, and a terminal position assurance (TPA) member 14.

The outer housing 11, as shown in FIG. 2, may include an outer fastener 111 to be fastened to the inner housing 12, and the connection terminal 112 externally exposed to be electrically connected to the external electronic component.

The inner housing 12, as shown in FIG. 2, may include an inner fastener 121 to be fastened to the outer fastener 111, and a preventer 123 configured to prevent the substrate 13 from entering a set distance or more toward a front of the inner housing 12. The inner housing 12 may be fastened to the outer housing 11 while fixed to the substrate 13, thereby electrically connecting a connecting terminal T of the substrate 13 to the connection terminal 112 of the outer housing 11.

The substrate 13, as shown in FIG. 2, may include the connecting terminal T connected to an electronic circuit formed on one side or inside thereof, and may be inserted and fixed to the inner housing 12. The substrate 13 may be provided, for example, in the shape of a flat plate. The substrate 13 may include, for example, a flexible material.

The TPA member 14, as shown in FIG. 2, may support the substrate 13 for the substrate 13 not to be separated from the inner housing 12. A connection between the inner housing 12, the substrate 13, and the TPA member 14 will be described below.

The inner housing 12, as shown in FIGS. 3-6, includes the inner fastener 121, a substrate inserting portion 122, the preventer 123, a fastening hole 124, a hot staking work recess 125, a protrusion guide recess 126, and a receiving groove 127.

The substrate inserting portion 122 may be formed to traverse the front and rear of the inner housing 12, thereby enabling the substrate 13 to be inserted into the inner housing 12. For example, as shown in FIG. 4, the substrate inserting portion 122 may have a shape that narrows in a direction from the rear to the front, thereby improving the assemblability and enabling the substrate 13 to be smoothly inserted into the inner housing 12.

Figure 3:
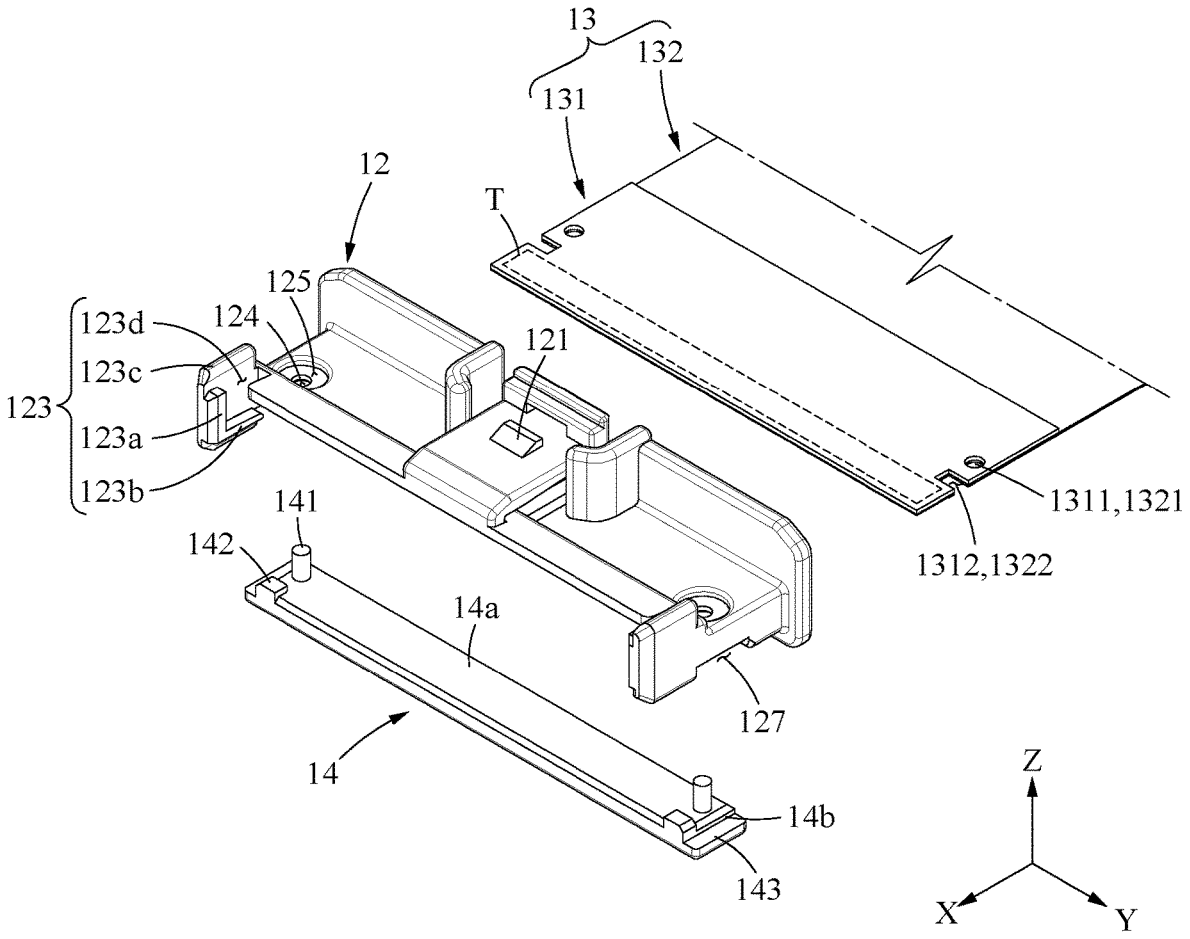
FIG. 3 is a perspective view of an inner housing, a substrate, and a terminal position assurance (TPA) member of the connector assembly.
Figure 4:
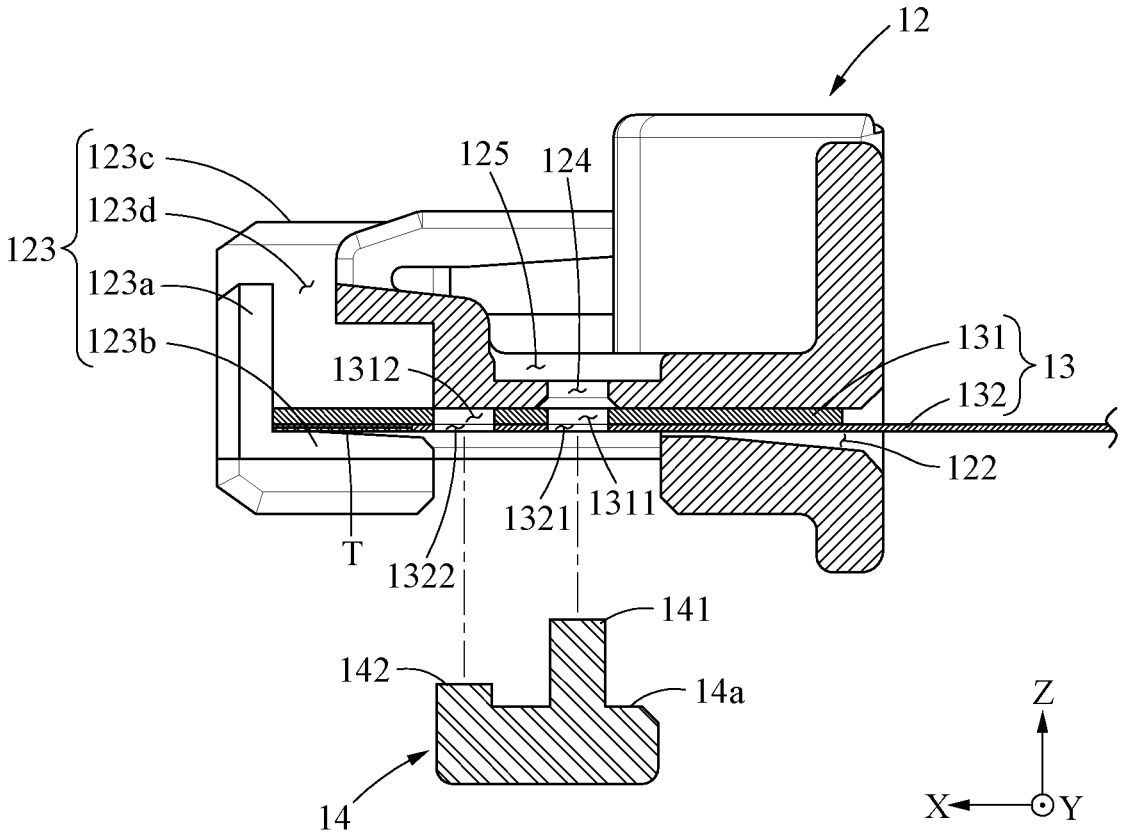
FIG. 4 is a sectional side view of the substrate inserted into the inner housing.
Figure 5:
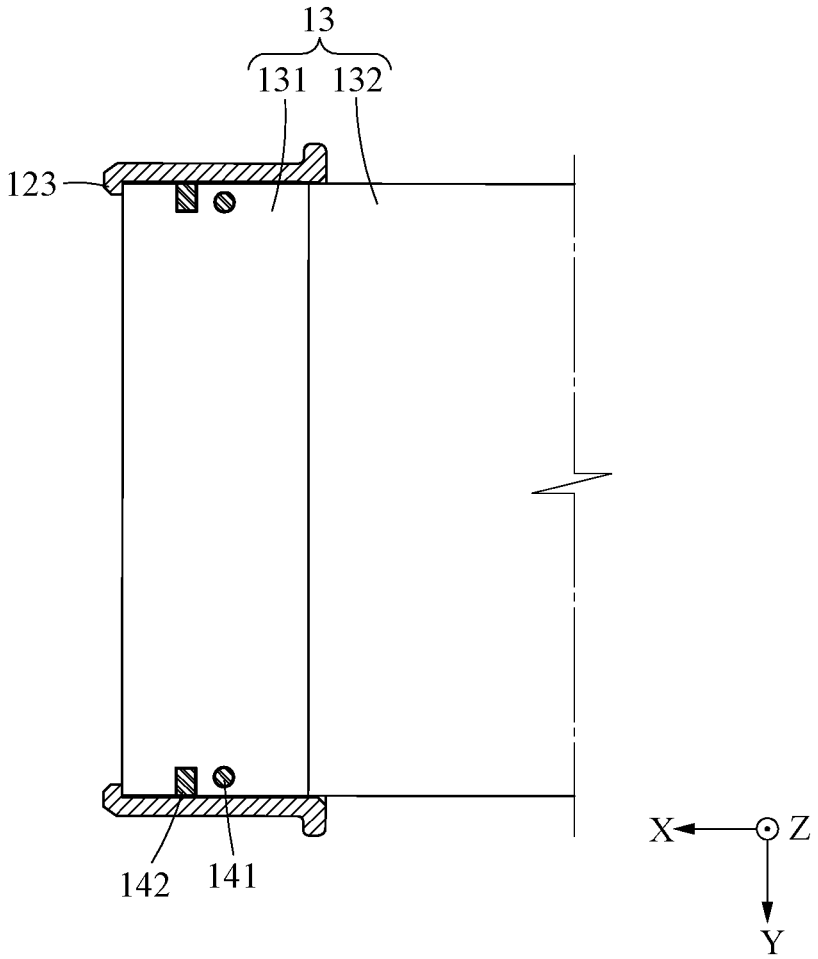
FIG. 5 is a sectional plan view of the substrate and the TPA member inserted into the inner housing.

The preventer 123, as shown in FIGS. 3-5, may prevent the substrate 13 from entering a set distance or more toward the front of the inner housing 12. The preventer 123 may prevent the substrate 13 from excessively protruding toward the front of the inner housing 12, and assist the substrate 13 to be positioned at an accurate assembly position. The preventer 123 may be formed to cover a portion of the front of the substrate inserting portion 122. For example, the preventer 123 may be provided in the shape of a hook, as shown in FIG. 5. The preventer 123 may include a block element 123*a*, a support element 123*b*, a protruding body 123*c*, and a check hole 123*d*.

As shown in FIGS. 3 and 4, the protruding body 123*c* may protrude toward the front from a side edge of the inner housing 12. For example, the vertical height of a front end portion of the protruding body 123*c* may decrease toward the front. By the shape as described above, the inner housing 12 may be smoothly inserted into the outer housing 11.

The block element 123*a* may be formed on the front side of the inner housing 12 to block the front end portion of the substrate 13, as shown in FIGS. 3 and 4. The block element 123*a* may be formed in a direction intersecting with an insertion direction of the substrate 13, for example, in a direction perpendicular to the insertion direction of the substrate 13. For example, the block element 123*a* may be provided in a shape that protrudes inward from the protruding body 123*c*.

The support element 123*b*, as shown in FIGS. 3 and 4, may prevent the substrate 13 from leaning downward in a state of being inserted into the inner housing 12. For example, the support element 123*b* may be provided in the shape that protrudes inward from the protruding body 123*c*. For example, the support element 123*b* may be elongated in a direction parallel with the insertion direction of the substrate 13. For example, the support element 123*b* may form a shape of "L" together with the block element 123*a*.

As shown in FIGS. 3 and 4, the check hole 123*d* may be formed in a direction that vertically penetrates through the inner housing 12, that is, in a direction perpendicular to the insertion direction of the substrate 13. By the structure described above, whether the substrate 13 is inserted to an appropriate position may be checked. Further, for example, when the connecting terminal T is formed only on one side of the substrate 13, whether the insertion direction of the substrate 13 is correct may be checked depending on whether the connecting terminal T is externally exposed through the check hole 123*d*.

Figure 6:
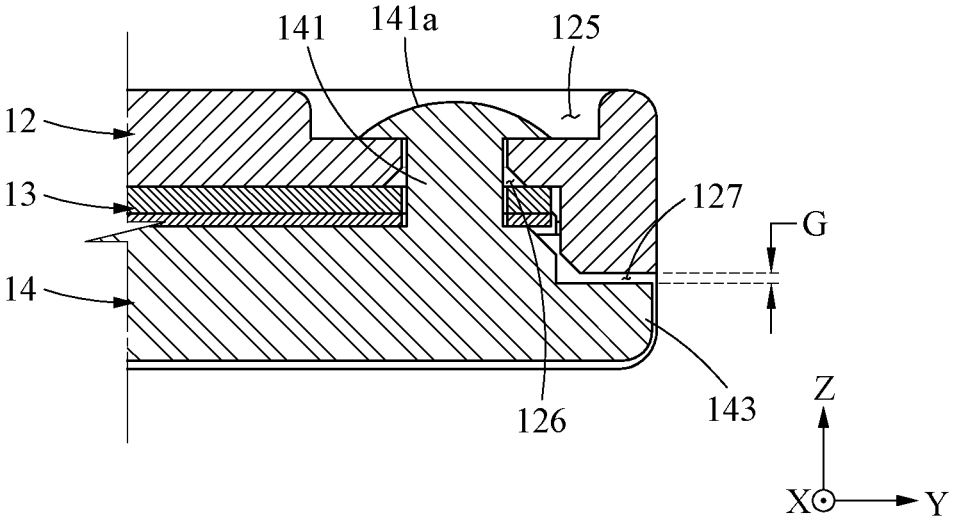
FIG. 6 is a sectional front view of the inner housing, the substrate, and the TPA member fixed to each other by a hot staking process.

A hot staking protrusion 141 of the TPA member 14 may penetrate through the fastening hole 124, as shown in FIGS. 3, 4, and 6. The fastening hole 124 may be formed to penetrate through the inner housing 12 in a direction perpendicular to the insertion direction of the substrate 13.

The hot staking work recess 125, shown in FIGS. 3, 4, and 5, may provide an extra space to perform a hot staking process. The hot staking work recess 125 may have a greater cross-section than that of the fastening hole 124 and be provided in the shape recessed from the top surface of the inner housing 12. For example, the hot staking work recess 125 may be circular as shown in the drawings, but the shape thereof is not necessarily limited thereto. By the structure described above, a fixing head 141*a* shown in FIG. 6, generated after the hot staking process is performed, is received in a portion recessed from the top surface of the inner housing 12, that is, a hot staking work recess 125, whereby the externally protruding height of the fixing head 141*a* may be reduced. Thus, during a process of coupling the inner housing 12 and the outer housing 11 to each other, interference in the coupling by the fixing head 141*a* may be reduced.

The protrusion guide recess 126, shown in FIG. 6, may guide the hot staking protrusion 141 to be inserted into the fastening hole 124. The protrusion guide recess 126 and the hot staking work recess 125 may be formed on opposite sides with the fastening hole 124 therebetween. The protrusion guide recess 126 may be provided in the shape that expands in a direction away from the fastening hole 124. That is, the protrusion guide recess 126 may be provided in the shape that expands in a direction toward the pressurizing surface 14*a* of the TPA member 14. By the structure described above, during a process of inserting the TPA member 14 into the inner housing 12, mutual interference between the hot staking protrusion 141 and the protrusion guide recess 126 may arrange the assembly position of the TPA member 14.

The receiving groove 127, shown in FIG. 6, may be recessed such that a wing 143 of the TPA member 14 are inserted thereinto. The receiving groove 127 may be provided, for example, in the shape of flattened "U" that encloses the front and the rear of the wing 143. By the receiving groove 127 and the wing 143, a user may visually and easily check the position at which the inner housing 12 and the TPA member 14 are coupled to each other. Further, the misalignment or separation of the inner housing 12 and the TPA member 14 may be reduced, until the inner housing 12 and the TPA member 14 are completely fastened through the hot staking process from the initial state in which the inner housing 12 and the TPA member 14 are temporarily fastened.

The substrate 13, as shown in FIGS. 3 and 4, may include a hot staking protrusion through-hole 1311, 1321 through which the hot staking protrusion 141 of the TPA member 14 penetrates, and an aligning protrusion receiving hole 1312, 1322 configured to receive an aligning protrusion 142 of the TPA member 14.

As shown in FIGS. 3 and 4, the substrate 13 may include, for example, a first substrate 131 and a second substrate 132 having different stiffnesses. The first substrate 131 may be a portion to be inserted and fixed to the inner housing 12 and include a stiffer material than the second substrate 132. The second substrate 132 may be coupled to the first substrate 131 and include a relatively flexible material. According to the second substrate 132, the second substrate 132 may be deformed by a worker to be appropriate for a workspace. By the first substrate 131 and the second substrate 132 having different stiffnesses, the entire substrate 13 may be stably fixed to the inner housing 12 with sufficient strength, and a portion of the substrate 13, other than the portion fixed to the inner housing 12, may have flexibility.

For example, the first substrate 131 may fully overlap the second substrate 132, as shown in FIGS. 3-5. In this example, the first substrate 131 may include the first hot staking through-hole 1311 and the first aligning protrusion receiving hole 1312, and the second substrate 132 may include the second hot staking through-hole 1321 and the first aligning protrusion receiving hole 1322. Of course, unlike the foregoing, only a portion of the first substrate 131 may be fixed to the second substrate 132.

As shown in FIGS. 3 and 4, the TPA member 14 may include the pressurizing surface 14*a* configured to pressurize the substrate 13 toward the inner housing 12, a side face 14*b*, the hot staking protrusion 141, the aligning protrusion 142, and the wing 143 protruding laterally from the side face 14*b*. For example, the TPA member 14 may include a pair of hot staking protrusion 141 spaced apart from each other in a direction perpendicular to the insertion direction of the substrate 13, and a pair of aligning protrusions 142 spaced apart from each other in the direction perpendicular to the insertion direction of the substrate 13.

As shown in FIGS. 4 and 6, the hot staking protrusion 141 may penetrate through the substrate 13 and the inner housing 12 through the hot staking protrusion through-hole 1311, 1321 formed in the substrate 13 and the fastening hole 124 formed in the inner housing 12. The aligning protrusion 142 may be inserted into the aligning protrusion receiving hole 1312, 1322 of the substrate 13 to restrict a movement of the substrate 13 with respect to the TPA member 14. The aligning protrusion 142 may be spaced apart from the hot staking protrusion 141 and protrude in the same direction as the hot staking protrusion 141. For example, one or more sides of the aligning protrusion 142 may linearly contact one or more sides of the aligning protrusion receiving hole 1312, 1322 to prevent a relative movement thereof in at least one direction.

Figure 7:
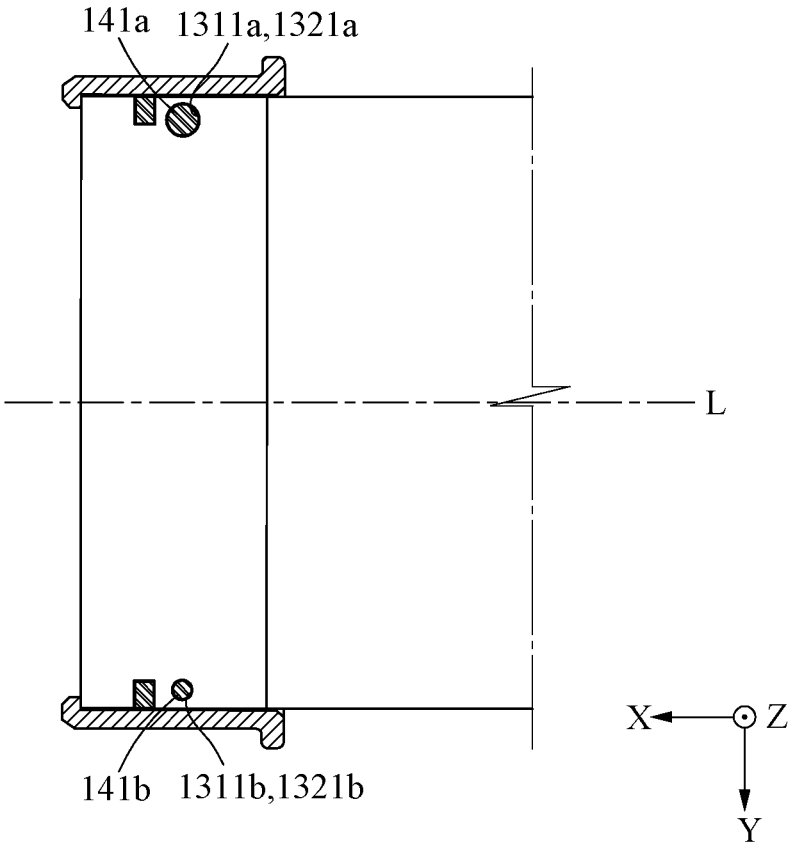
FIG. 7 is a sectional plan view of a substrate and a TPA member inserted into an inner housing according to another embodiment.
Figure 8:
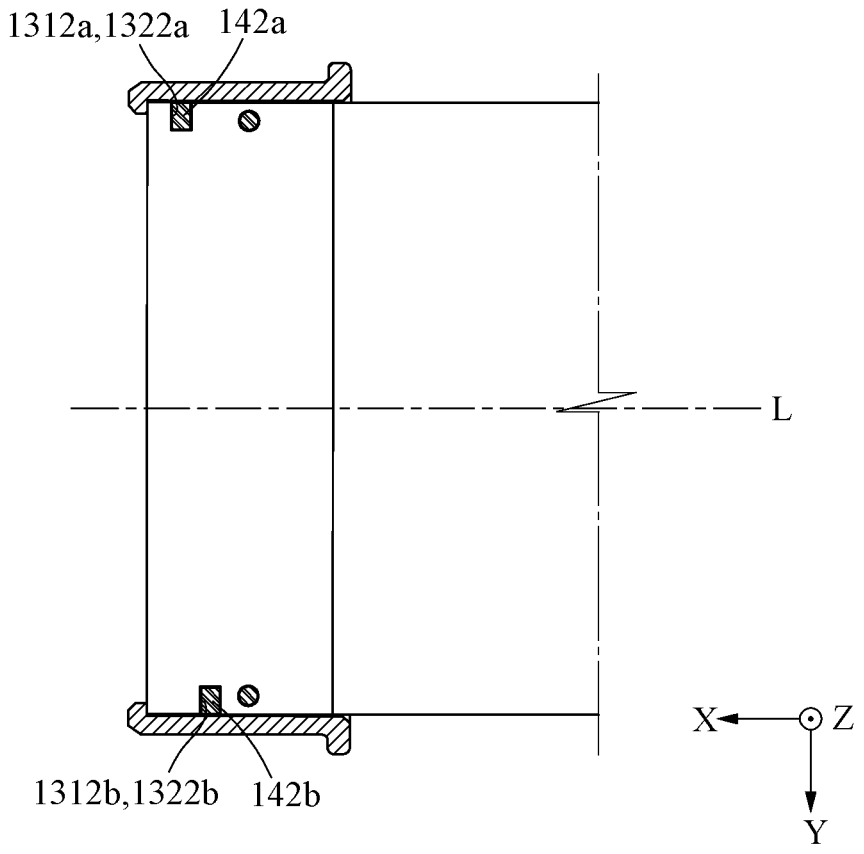
FIG. 8 is a sectional plan view of a substrate and a TPA member inserted into an inner housing according to another embodiment.
Figure 9:
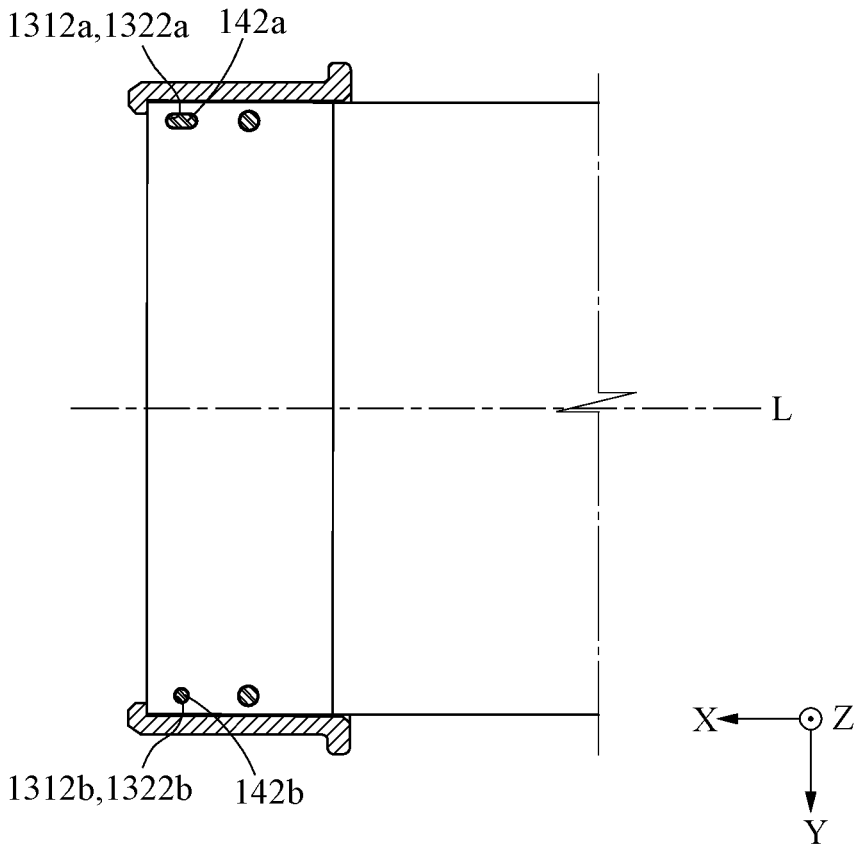
FIG. 9 is a sectional plan view of a substrate and a TPA member inserted into an inner housing according to another embodiment.

The aligning protrusion 142 and the aligning protrusion receiving hole 1312, 1322 may be provided in the same shape. For example, as shown in FIGS. 5, 7, and 8, the aligning protrusion 142 and the aligning protrusion receiving hole 1312, 1322 may be provided in the same polygonal shape. Meanwhile, as shown in FIG. 9, the aligning protrusion 142 and the aligning protrusion receiving hole 1312, 1322 are not necessarily provided in the polygonal shape, and may be provided in any shape including an arc, such as a circular or oval shape. The aligning protrusion 142 and the aligning protrusion receiving hole 1312, 1322 are not limited to the example described above, and may be provided in any structure that helps the arrangement by restricting the movement unless otherwise described.

Hereinafter, the hot staking process will be described with reference to FIG. 6.

The hot staking process may be performed in a state in which the substrate 13 is pressurized by the pressurizing surface 14*a* of the TPA member 14 to be in close contact with the inner housing 12. Here, the hot staking process refers to a process that heats and pressurizes a portion of the hot staking protrusion 141 exposed through the hot staking work recess 125. Through the process, the end portion of the hot staking protrusion 141 may be deformed into the fixing head 141*a* with a greater diameter than the fastening hole 124, thereby firmly fixing the inner housing 12, the substrate 13, and the TPA member 14 to each other.

Meanwhile, in a state before the hot staking process is performed, that is, in an initial state in which the substrate 13 and the TPA member 14 are temporarily fastened to the inner housing 12, the wing 143 and the receiving groove 127 may be spaced apart from each other to form a gap G, as shown in FIG. 6. By the gap G, the TPA member 14 may pressurize, with sufficient force, the substrate 13 to be in close contact with the inner housing 12, without being interfered with by another portion of the inner housing 12.

Meanwhile, if a decreased amount of the thickness of the substrate 13 occurring during the pressurizing process is greater than the length of the gap G in the initial state, the wing 143 may rise and be interfered with by the receiving groove 127, and thus the TPA member 14 may not rise any further. By the structure described above, by preventing the pressurizing surface 14*a* of the TPA member 14 from excessively pressurizing the substrate 13, damage to the substrate 13 may be reduced.

As shown in FIGS. 7 and 8, the TPA member 14 may be provided in the shape asymmetric based on a virtual line L which is parallel with the insertion direction (X-axial direction) of the substrate 13 and passes through the center of the TPA member 14. By providing the asymmetric shape based on the virtual line L, the worker may insert the substrate 13 into the TPA member 14 in a predetermined direction. By the structure described above, it is possible to prevent the connector assembly 1 from being out of operation due to the misassembly by the worker when the connecting terminal T of the substrate 13 is formed on only one side as shown in FIG. 3.

For example, as shown in FIG. 7, the TPA member 14 may include a pair of hot staking protrusion 141*a* and 141*b* having different diameters, the first substrate 131 may include a pair of first hot staking protrusion through-hole 1311*a* and 1311*b* having different diameters, and the second substrate 132 may include a pair of second hot staking protrusion through-holes 1321*a* and 1321*b* having different diameters. Similarly, the inner housing 12 may include a pair of fastening holes 124 having different diameters.

In another example, as shown in FIG. 8, the TPA member 14 may include a pair of aligning protrusions 142*a* and 142*b* formed at different positions, the first substrate 131 may include a pair of first aligning protrusion receiving holes 1312*a* and 1312*b* formed at different positions, and the second substrate 132 may include a pair of second aligning protrusion receiving holes 1322*a* and 1322*b* formed at different positions.

In still another example, as shown in FIG. 9, the TPA member 14 may include a pair of aligning protrusions 142*a* and 142*b* formed in different shapes, the first substrate 131 may include a pair of first aligning protrusion receiving holes 1312*a* and 1312*b* formed in different shapes, and the second substrate 132 may include a pair of second aligning protrusion receiving holes 1322*a* and 1322*b* formed in different shapes.

As shown in FIGS. 8 and 9, the aligning protrusions 142 may be formed asymmetrically based on the virtual line L which is parallel with the insertion direction of the substrate 13 and passes through the center of the TPA member 14. For example, as shown in the drawings, the aligning protrusions 142 may be respectively formed on both sides based on the virtual line L at different positions and/or in different shapes. Unlike the drawings, an aligning protrusion 142 may be formed only one side based on the virtual line L.

The aligning protrusion receiving hole 1312, 1322 may be provided in the shape that is cut inward from an outer edge of the substrate 13, as shown in FIGS. 7 and 8. However, unlikely, the aligning protrusion receiving hole 1312, 1322 may be provided in an inner side of the substrate 13, as shown in FIG. 9. That is, the aligning protrusion receiving hole 1312, 1322 may be provided in the shape of a closed loop in the inner side of the substrate 13. By the structure described above, a negative effect on the stiffness of the substrate 13 may be reduced, and the fastening force between the substrate 13 and the TPA member 14 may improve, when compared to the shapes shown in FIGS. 7 and 8.

Figure 10:
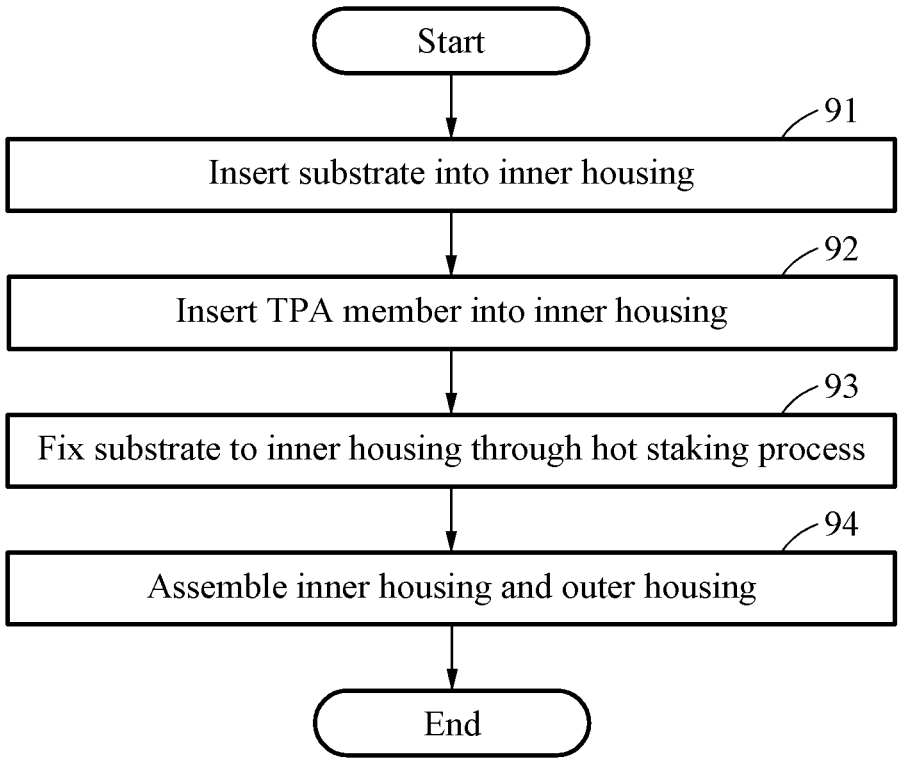
FIG. 10 is a flowchart of a method of manufacturing the connector assembly.

As shown in FIG. 10, a method of manufacturing the connector assembly 1 may include ① operation 91 of inserting the substrate 13 into the inner housing 12, ② operation 92 of inserting the TPA member 14 into the inner housing 12 in a state in which the substrate 13 is inserted into the inner housing 12, the TPA member 14 including the hot staking protrusion 141 penetrating through the substrate 13 and the inner housing 12, ③ operation 93 of fixing the substrate 13 and the TPA member 14 to the inner housing 12 by heating and pressurizing an end portion of the hot staking protrusion 141, and ④ operation 94 of assembling the outer housing 11 and the inner housing 12.

Operation 93 may be performed, for example, in a state in which the substrate 13 is pressurized between the inner housing 12 and the TPA member 14. By the process described above, the substrate 13 may be firmly fixed between the inner housing 12 and the TPA member 14, and thus noise produced when the substrate 13 bumps into another adjacent member or vibrates, or abrasion caused by friction may be reduced. It is possible to minimize a gap caused by vibration transferred from the outside (for example, an automobile), protect an electric contact site, and enable currents to pass stably, by firmly fixing products through the hot staking process.

A number of example embodiments have been described above. Nevertheless, it should be understood that various modifications may be made to these example embodiments. For example, suitable results may be achieved if the described techniques are performed in a different order and/or if components in a described system, architecture, device, or circuit are combined in a different manner and/or replaced or supplemented by other components or their equivalents.

What is claimed is:

1. A connector assembly, comprising:

an inner housing having an inner fastener, a substrate insertion portion formed to traverse the inner housing, and a preventer;

a substrate inserted into the insertion portion of the inner housing, the substrate having a connecting terminal connected with an electronic circuit formed on a side or an inside of the substrate;

an outer housing having an outer fastener, and a connection terminal externally exposed to be electrically connected to an external electronic component, the connection terminal electrically connected to the connecting terminal when the outer housing is fastened to the inner housing; and a terminal position assurance (TPA) member supporting the substrate for the substrate not to be separated from the inner housing, the TPA member having a hot staking protrusion penetrating through the substrate and the inner housing;

wherein the inner fastener is adapted to be fastened to the outer fastener, and the preventer adapted to limit an insertion depth of the substrate into the substrate insertion portion and toward a front of the inner housing.

2. The connector assembly of claim 1, wherein the inner housing includes a fastening hole through which the hot staking protrusion penetrates and a protrusion guide recess provided in the shape that expands in a direction away from the fastening hole, the protrusion guide recess guides the hot staking protrusion to be inserted into the fastening hole.

3. The connector assembly of claim 1, wherein the TPA member has an aligning protrusion spaced apart from the hot staking protrusion and protruding in a same direction as the hot staking protrusion.

4. The connector assembly of claim 3, wherein the substrate includes a hot staking protrusion through-hole through which the hot staking protrusion penetrates and an aligning protrusion receiving hole receiving the aligning protrusion.

5. The connector assembly of claim 4, wherein the aligning protrusion is inserted into the aligning protrusion receiving hole to restrict a movement of the substrate with respect to the TPA member.

6. The connector assembly of claim 4, wherein the TPA member has a plurality of aligning protrusions, the plurality of aligning protrusions being formed asymmetrically based on a virtual line which is parallel with an insertion direction of the substrate and passes through a center of the TPA member.

7. The connector assembly of claim 4, wherein the aligning protrusion and the aligning protrusion receiving hole each have a polygonal shape, one or more sides of the aligning protrusion linearly contact one or more sides of the aligning protrusion receiving hole to prevent a relative movement thereof in at least one direction.

8. The connector assembly of claim 1, wherein the TPA member has a shape asymmetric based on a virtual line which is parallel with an insertion direction of the substrate and passes through a center of the TPA member.

9. The connector assembly of claim 8, wherein the hot staking protrusion is a first hot staking protrusion and the TPA member has a second hot staking protrusion having a diameter different from the first hot staking protrusion.

10. The connector assembly of claim 8, wherein the TPA member has a pair of aligning protrusions formed at different positions based on the insertion direction of the substrate.

11. The connector assembly of claim 8, wherein the TPA member has a pair of aligning protrusions formed in different shapes.

12. The connector assembly of claim 1, wherein the inner housing includes a fastening hole through which the hot staking protrusion penetrates and a hot staking work recess, the hot staking work recess having a greater cross-section than the fastening hole and a shape recessed from a top surface of the inner housing.

13. The connector assembly of claim 12, wherein the TPA member has a pressurizing surface pressurizing the substrate toward the inner housing through a hot staking process that heats and pressurizes a portion of the hot staking protrusion exposed through the hot staking work recess in a state in which the substrate is pressurized by the pressurizing surface to be in close contact with the inner housing, an end portion of the hot staking protrusion is deformed into a fixing head with a greater diameter than the fastening hole, the fixing head fixing the inner housing, the substrate, and the TPA member to each other.

14. A connector assembly, comprising:

an inner housing;

a substrate inserted into the inner housing; and a terminal position assurance (TPA) member supporting the substrate for the substrate not to be separated from the inner housing, the TPA member having a hot staking protrusion penetrating through the substrate and the inner housing, wherein:

the inner housing includes a fastening hole through which the hot staking protrusion penetrates and a hot staking work recess, the hot staking work recess having a greater cross- section than the fastening hole and a shape recessed from a top surface of the inner housing;

the TPA member has a pressurizing surface pressurizing the substrate toward the inner housing through a hot staking process that heats and pressurizes a portion of the hot staking protrusion exposed through the hot staking work recess in a state in which the substrate is pressurized by the pressurizing surface to be in close contact with the inner housing, an end portion of the hot staking protrusion is deformed into a fixing head with a greater diameter than the fastening hole, the fixing head fixing the inner housing, the substrate, and the TPA member to each other; and the TPA member has a wing protruding laterally from a side face of the TPA member, the inner housing has a receiving groove recessed and in which the wing is inserted, the wing and the receiving groove are spaced apart from each other to form a gap in an initial state in which the substrate and the TPA member are temporarily fastened to the inner housing.

15. The connector assembly of claim 14, wherein the inner housing has a preventer preventing the substrate from entering a set distance or more toward a front of the inner housing.

16. The connector assembly of claim 14, wherein the wing interferes with the receiving groove to prevent the pressurizing surface from excessively pressurizing the substrate if a decreased amount of the thickness of the substrate occurring during the pressurizing is greater than a length of the gap in the initial state.

17. The connector assembly of claim 14, wherein the substrate has a connecting terminal connected with an electronic circuit formed on a side or an inside of the substrate.

18. The connector assembly of claim 17, further comprising an outer housing having a connection terminal externally exposed to be electrically connected to an external electronic component, the connection terminal is electrically connected to the connecting terminal when the outer housing is fastened to the inner housing.

19. A method of manufacturing a connector assembly, comprising:

inserting a substrate into an inner housing, the substrate having a connecting terminal connected with an electronic circuit formed on a side or an inside of the substrate, the inner housing including an inner fastener, a substrate insertion portion formed to traverse the inner housing for receiving the substrate, and a preventer for limiting an insertion depth of the substrate into the substrate insertion portion and toward a front of the inner housing;

inserting a terminal position assurance (TPA) member into the inner housing in a state in which the substrate is inserted into the inner housing, the TPA member having a hot staking protrusion penetrating through the substrate and the inner housing;

fixing the substrate and the TPA member to the inner housing by heating and pressurizing an end portion of the hot staking protrusion; and inserting the inner housing into an outer housing, the outer housing including an outer fastener for fastening to the inner fastener, and a connection terminal externally exposed to be electrically connected to an external electronic component, the connection terminal electrically connected to the connecting terminal when the outer housing is fastened to the inner housing.

20. The method of claim 19, wherein the fixing is performed in a state in which the substrate is pressurized between the inner housing and the TPA member.

* * * * *